US005772802A

United States Patent [19]

Sun et al.

[11] Patent Number: 5,772,802

[45] Date of Patent: Jun. 30, 1998

[54] METHOD FOR MAKING CAN END AND TAB STOCK

[75] Inventors: T. C. Sun, Danville; William Betts, Pleasanton, both of Calif.

[73] Assignee: Kaiser Aluminum & Chemical Corporation, Pleasanton, Calif.

[21] Appl. No.: 538,415

[22] Filed: Oct. 2, 1995

[51] Int. Cl.[6] ..... C22F 1/04

[52] U.S. Cl. ..... 148/551; 148/552; 148/693; 148/695; 148/702; 420/533; 420/542; 420/547

[58] Field of Search ..... 148/551, 552, 148/692, 693, 695, 700, 702, 439, 440; 420/533, 534, 542, 546, 547

[56] References Cited

U.S. PATENT DOCUMENTS 5,470,405 11/1995 Wyatt-Mair et al. ..... 148/551

OTHER PUBLICATIONS

*ASM Handbook,* vol. 4, Heat Treating, pp. 860–866, ASM, 1991.

*Primary Examiner*—George Wyszomierski

*Attorney, Agent, or Firm*—Philip L. McGarrigle

[57] ABSTRACT

Can or lid stock and a method for its manufacture in which a low alloy content aluminum alloy is strip cast to form a hot strip cast feedstock, the hot feedstock is rapidly quenched to prevent substantial precipitation, annealed and quenched rapidly to prevent substantial precipitation of alloying elements and then cold rolled. The can end and tab stock of the invention has strength and formability equal to higher alloy content aluminum alloy.

27 Claims, 3 Drawing Sheets

METHOD FOR MAKING CAN END AND TAB STOCK

BACKGROUND OF THE INVENTION

The present invention relates to a process for making can end and tab stock for aluminum alloy beverage containers and, more particularly, to a continuous process for making such end and tab stock, allowing it to be produced more economically and efficiently.

PRIOR ART

It is now conventional to manufacture beverage containers from aluminum alloys. An aluminum alloy sheet stock is first blanked into a circular configuration and then cupped. The side wall are ironed by passing the cup through a series of dies having diminishing bores. The dies thus produce an ironing effect which lengthens the sidewall to produce a can body thinner in dimension than its bottom.

Thus, formability is a key characteristic of aluminum alloy to be used in manufacturing cans. Such cans are most frequently produced from aluminum alloys of the 3000 series. Such aluminum alloys contain alloy elements of both magnesium and manganese. In general, the amount of manganese and magnesium used in can body stock is generally present at levels of about 1% by weight.

In the manufacture of such beverage containers, it has been the practice in the industry to separately form both a top lid of such cans and tabs for easy opening of such lids separately and using different alloys. Such lids and tabs are then shipped to the filler of the beverage can and applied once the containers has been filled by a filler. The requirements for can ends and tabs are generally quite different than those for can bodies. In general, greater strength is required for can ends and tabs, and that requirement for greater strength has dictated that such can ends and tabs be fabricated from a different aluminum alloy. One such alloy commonly used is alloy AA5182, a different aluminum alloy containing relatively high amounts of magnesium to provide the added strength and formability necessary for can ends and tabs. AA5182 typically contains magnesium in an amount of about 4.4% by weight, thus adding to the cost of the alloy for can ends and tabs.

It has been proposed to employ, as the aluminum alloy used in the fabrication of can ends and tabs, alloy from the 3000 series, such as AA3104. Because such alloys generally have diminished strength and formability as compared to AA5182, it has been necessary to employ can ends fabricated from AA3104 which have a greater thickness and thus are more expensive.

In copending application Ser. No. 08/531,554, filed Sep. 18, 1995, there is described new can end and tab stock made from less expensive aluminum alloy, as is described in that copending application. It has been found that aluminum alloys having lower alloy contents may be used in fabricating end and tab stock for aluminum alloy containers where the alloy is strip cast to form a hot strip for the stock and then the feedstock is rapidly quenched (e.g., by air, water or other medium) to prevent substantial precipitation of alloy elements as intermetallic compounds. It has been found that strip casting followed by quenching allows the use of less expensive, lower alloy aluminum alloys without sacrificing strength.

It is accordingly an object of the present invention to provide can end and tab stocks and can ends and tabs made therefrom which overcome the foregoing disadvantages.

It is more specifically an object of the present invention to provide can end and tab stock and a method for fabricating same in which use is made of aluminum alloys containing less alloying elements without sacrificing strength and formability.

It is a more specific object of the present invention to provide can end and tab stock therefor and a method for fabricating them which can be employed with aluminum alloys containing less than 2% magnesium without sacrificing the necessary strength and formability of the can ends and tabs.

These and other objects and advantages of the invention appear more fully hereinafter from a detailed description of the invention.

SUMMARY OF THE INVENTION

The concepts of the present invention reside in the discovery that aluminum alloys containing lesser amounts of alloying elements can, nonetheless, be used in fabricating can ends and tabs without sacrificing strength or formability by utilizing a fabrication process in which the aluminum alloy, preferably containing less than 2% by weight of magnesium as an alloying element, is formed into sheet stock for making can ends and tabs. In accordance with the practice of the invention, the aluminum alloy is strip cast between a pair of continuous moving metal belts to form a hot strip cast feedstock, and then the feedstock is rapidly quenched to prevent substantial precipitation of aluminum alloying elements as intermetallic compounds.

Thereafter, with or without additional rolling, the quenched feedstock is annealed and rapidly quenched, also to prevent substantial precipitation of alloying elements. It has been found that the intermediate annealing and quenching steps substantially improve the formability of the feedstock while maintaining exceptionally high metallurgical properties including ultimate tensile strength and yield strength.

It has been unexpectedly found that such a fabrication process provides an aluminum alloy feedstock having equal or better metallurgical and formability characteristics as compared to aluminum alloys conventionally used in forming can ends and tabs.

It has been found in accordance with the preferred embodiment of the present invention that the fabrication process can be applied to alloys of the 3000 series such as AA3104 without the need to increase the thickness of the can ends and tabs to achieve comparable strips. Without limiting the present invention as to theory, it is believed that the techniques of strip casting followed by rapid quenching provide an alloy sheet stock having improved strength by reason of its solid solution and age hardening. In addition, it is believed, once again, without limiting the present invention as to theory, that formability of the sheet stock of this invention used in forming can ends and tabs is equal to or better than these DC-cast aluminum alloys containing greater quantities of alloying elements. Thus, the present invention allows can ends and tabs to be produced from less expensive aluminum alloys without sacrificing the metallurgical properties of those more expensive alloys. It has also been found that the intermediate anneal and quench steps promote the formability of the can end and tab stock without adversely effecting its strength.

In the most preferred embodiment of the invention, the sequence of steps of strip casting, quenching, rolling, annealing, quenching and rolling is preferably carried out in a continuous, in-line sequence. That has a further advantage of eliminating process and material handling steps typically employed in the prior art. The strip casting can be used to produce a cast strip having a thickness less than 1.0 inches, and preferably within the range of 0.01 to 0.2 inches. In addition, in accordance with the most preferred embodiment of the invention, the widths of the strip is narrow contrary to conventional wisdom. That facilitates ease of in-line threading and processing and allows production lines for the manufacture of can ends and tabs to be physically located with or as part of a can making facility.

DETAILED DESCRIPTION OF THE INVENTION

Figure 1:
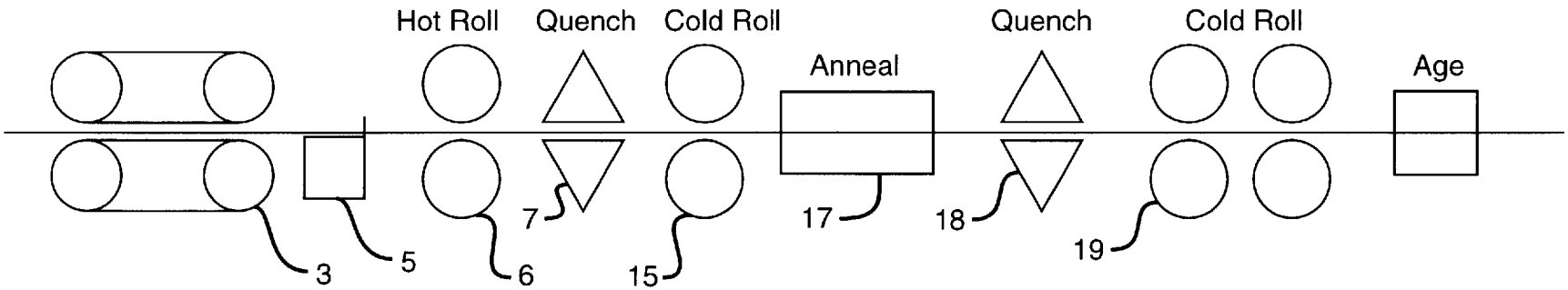
FIG. 1 is a schematic illustration of the continuous in-line sequence of steps employed in the practice of the invention.

The sequence of steps employed in the preferred embodiment of the invention are illustrated in FIG. 1. One of the advances of the present invention is that the processing steps for producing sheet stock can be arranged in one or two continuous in-line sequences whereby the various process steps are carried out in sequence. The practice of the invention in a narrow width (for example, 12 inches) make it practical for the present process to be of a relatively small size conveniently and economically located in or adjacent to sheet stock customer facilities. In that way, the process of the invention can be operated in accordance with the particular technical and throughput needs for sheet stock users.

In the preferred embodiment, molten metal is delivered from a furnace not shown in the drawing to a metal degassing and filtering device to reduce dissolved gases and particulate matter from the molten metal, also not shown. The molten metal is immediately converted to a cast feedstock or strip 4 in casting apparatus 3.

The feedstock employed in the practice of the present invention can be prepared by any of a number of casting techniques well known to those skilled in the art, including twin belt casters like those described in U.S. Pat. No. 3,937,270 and the patents referred to therein. In some applications, it may be preferable to employ as the technique for casting the aluminum strip the method and apparatus described in copending application Ser. Nos. 08/184,581, 08/173,663 and 07/173,369, the disclosure of which are incorporated herein by reference.

Figure 2:
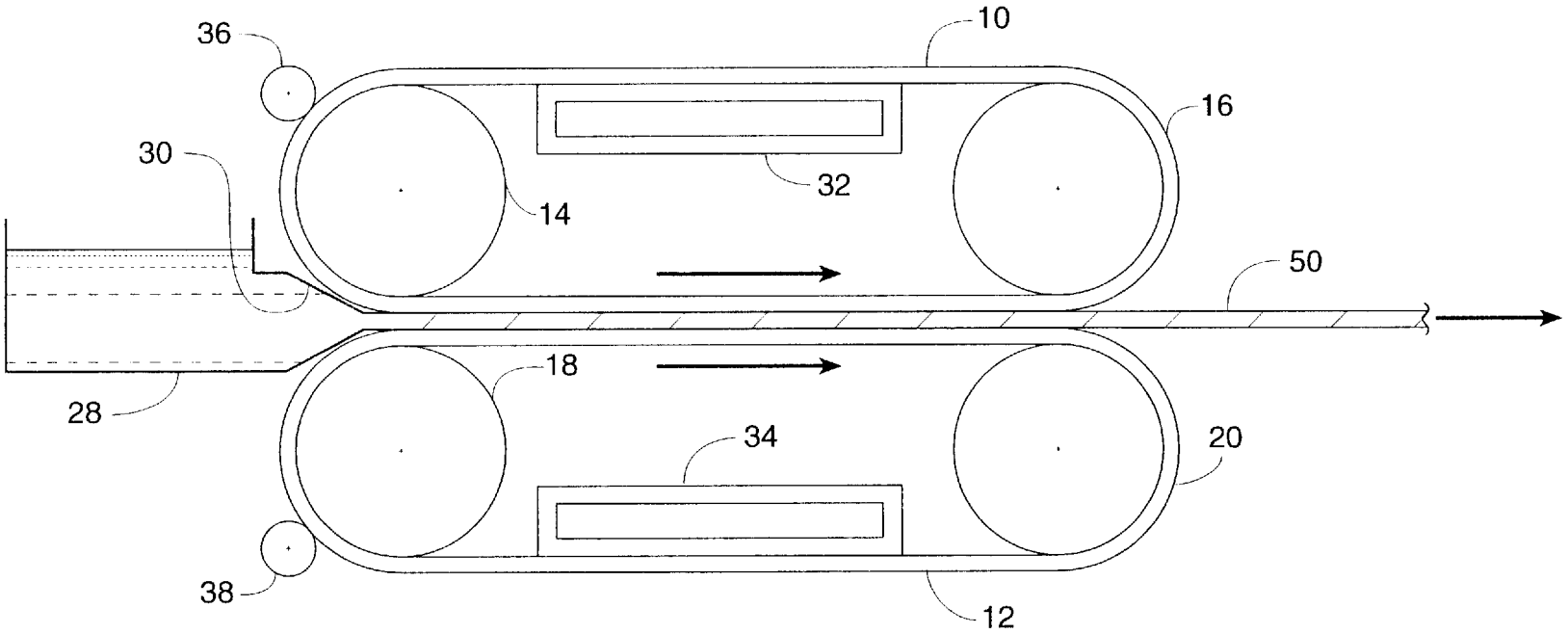
FIG. 2 is a schematic illustration of preferred strip casting apparatus used in the practice of the invention.

The strip casting technique described in the foregoing copending applications which can advantageously be employed in the practice of this invention is illustrated in FIG. 2 of the drawing. As there shown, the apparatus includes a pair of endless belts 10 and 12 carried by a pair of upper pulleys 14 and 16 and a pair of corresponding lower pulleys 18 and 20. Each pulley is mounted for rotation, and is a suitable heat resistant pulley. Either or both of the upper pulleys 14 and 16 are driven by suitable motor means or like driving means not illustrated in the drawing for purposes of simplicity. The same is true for the lower pulleys 18 and 20. Each of the belts 10 and 12 is an endless belt and is preferably formed of a metal which has low reactivity with the aluminum being cast. Low-carbon steel or copper are frequently preferred materials for use in the endless belts.

The pulleys are positioned, as illustrated in FIG. 2, one above the other with a molding gap therebetween corresponding to the desired thickness of the aluminum strip being cast.

Molten metal to be cast is supplied to the molding gap through suitable metal supply means such as a tundish 28. The inside of the tundish 28 corresponds substantially in width to the width of the belts 10 and 12 and includes a metal supply delivery casting nozzle 30 to deliver molten metal to the molding gap between the belts 10 and 12.

The casting apparatus also includes a pair of cooling means 32 and 34 positioned opposite that position of the endless belt in contact with the metal being cast in the molding gap between the belts. The cooling means 32 and 34 thus serve to cool belts 10 and 12, respectively, before they come into contact with the molten metal. In the preferred embodiment illustrated in FIG. 2, coolers 32 and 34 are positioned as shown on the return run of belts 10 and 12, respectively. In that embodiment, the cooling means 32 and 34 can be conventional cooling devices such as fluid nozzles positioned to spray a cooling fluid directly on the inside and/or outside of belts 10 and 12 to cool the belts through their thicknesses. Further details respecting the strip casting apparatus may be found in the cited copending applications.

Returning to FIG. 1, the feedstock 4 from the strip caster 3 is moved through optional shear and trim station 5 into optional one or more hot rolling stands 6 where its thickness is decreased. Immediately after the hot rolling operation has been performed in the hot rolling stands 6, the feedstock is passed to a quenching station 7 wherein the feedstock, still at an elevated temperature from the casting operation, is contacted with a cooling fluid. Any of a variety of quenching devices may be used in the practice of the invention. Typically, the quenching station is one in which a cooling fluid, either in liquid or gaseous form, is sprayed onto the hot feedstock to rapidly reduce its temperature. Suitable cooling fluids include water, air, liquefied gases such as carbon dioxide or nitrogen, and the like. It is important that the quench be carried out quickly to reduce the temperature of the hot feedstock rapidly to prevent substantial precipitation of alloying elements from solid solution.

It will be appreciated by those skilled in the art that there can be expected some insignificant precipitation of intermetallic compounds that do not affect the final properties. Such minor precipitation has no affect on those final properties either by reason of the fact that the intermetallic compounds are small and redissolve during the rapid annealing step in any case, or their volume and type have a negligible effect on the final properties. As used herein, the term "substantial" refers to precipitation which affects the final sheet properties.

Figure 3:
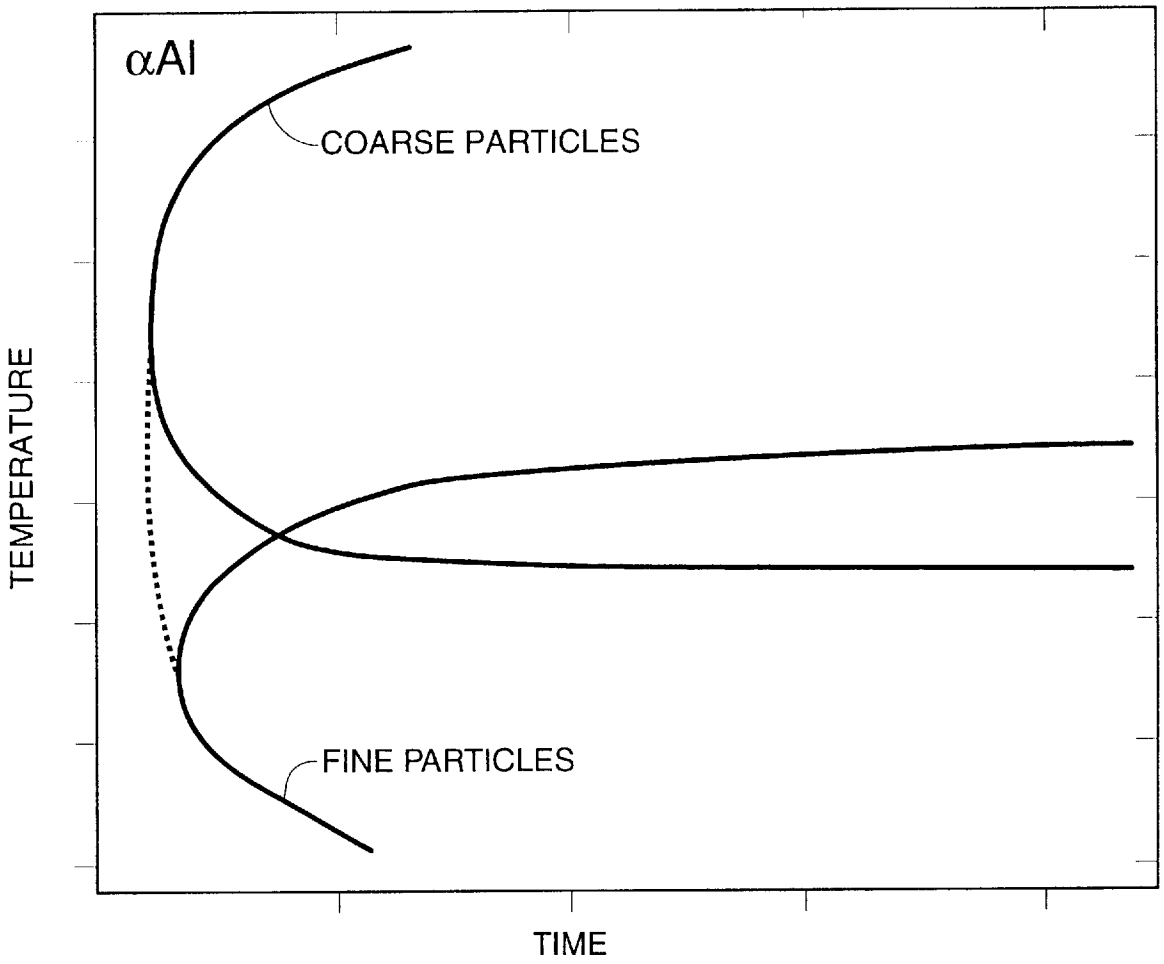
FIG. 3 is a generalized time temperature-transformation diagram for aluminum alloys illustrating how rapid heating and quenching serves to eliminate or at least substantially minimize precipitation of alloying elements in the form of intermetallic compounds.

In general, the temperature is reduced from a temperature ranging from about 600° to about 950° F. to a temperature below 550° F., and preferably below 450° F. The importance of rapid cooling following hot rolling is illustrated by FIG. 3 of the drawings, a generalized graphical representation of the formation of precipitates of alloying elements as a function of time and temperature. Such curves, which are generally known in the art as time temperature-transformation or "C" curves, show the formation of coarse and fine particles formed by the precipitation of alloying elements as intermetallic compounds as an aluminum alloy is heated or cooled. Thus, the cooling afforded by the quench operation immediately following hot rolling is effected at a rate such that the temperature-time line followed by the aluminum alloy during the quench remains between the ordinate and the curves. That ensures that cooling is effected sufficiently rapidly so as to avoid substantial precipitation of such alloying elements as intermetallic compounds.

After quenching, the feedstock may be rolled and stored until needed. Alternatively, it may be continuously passed to an optional cold rolling stand 15 and then to a flash annealing furnace 17 in which the feedstock, in either coil or strip form, is rapidly heated. That rapid annealing step provides an improved combination of metallic properties such as grain size, strength and formability. Because the feedstock is rapidly heated, substantial precipitation of alloying elements is likewise avoided. Thus the heating operations should be carried out to the desired annealing and recrystallization temperature such that the temperature-time line followed by the aluminum alloy does not cross the C-curves illustrated in FIG. 3 in such a way as to cause substantial precipitation.

Immediately following the heater 17 is a quench station 18 in which the strip is rapidly cooled or quenched by means of a conventional cooling fluid to a temperature suitable for cold rolling. Because the feedstock is rapidly cooled in the quench step 18, there is insufficient time to cause any substantial precipitation of alloying elements from solid solution.

In the preferred embodiment of the invention, the feedstock is passed from the quenching step to one or more cold rolling stands 19 in which the feedstock is worked to harden the alloy and reduce its thickness to finish gauge. In the preferred practice of the invention, it is sometimes desirable, after cold rolling to age the cold-rolled strip at an elevated temperature, preferably at temperatures within the range of 220°–400° F. for about 1 to about 10 hours. Because the strip has been quenched immediately following hot rolling so as to substantially minimize precipitation of alloying elements as intermetallic compounds, the cast strip has an unusually high level of solute supersaturation. Thus, the aging step causes the ultimate tensile strength and yield strength to increase along with formability.

Thereafter, the strip which has been aged can either be coiled until needed or it can be immediately formed into can ends and/or tabs using conventional techniques.

As will be appreciated by those skilled in the art, it is possible to realize the benefits of the present invention without carrying out the cold rolling step in the cold mill 19 as part of the in-line process. Thus, the use of the cold rolling step is an optional process step of the present invention, and can be omitted entirely or it can be carried out in an off-line fashion, depending on the end use of the alloy being processed. As a general rule, carrying out the cold rolling step off-line decreases the economic benefits of the preferred embodiment of the invention in which all of the process steps are carried out in-line.

It has become the practice in the aluminum industry to employ wider cast strip or slab for reasons of economy. In the preferred embodiment of this invention, it has been found that, in contrast to this conventional approach, the economics are best served when the width of the cast feedstock 4 is maintained as a narrow strip to facilitate ease of processing and enable use of small decentralized strip rolling plants. Good results have been obtained where the cast feedstock is less than 24 inches wide, and preferably is within the range of 2 to 20 inches wide. By employing such narrow cast strip, the investment can be greatly reduced through the use of small, two-high rolling mills and all other in-line equipment. Such small and economic micromills of the present invention can be located near the points of need, as, for example, can end or tab facilities. That in turn has the further advantage of minimizing costs associated with packaging, shipping of products and customer scrap. Additionally, the volume and metallurgical needs of a can plant can be exactly matched to the output of an adjacent micromill.

In the practice of the invention, the hot rolling exit temperature is generally maintained within the range of 300° to 1000° F. Hot rolling is typically carried out in temperatures within the range of 300° F. to the solidus temperature of the feedstock.

The annealing step in which the feedstock is subjected to solution heat treatment to cause recrystallization is effected at a temperature within the range of 600° to 1200° F. for less than 120 seconds, and preferably 0.1 to 10 seconds. Immediately following heat treatment, the feedstock in the form of strip 4 is water quenched to temperatures necessary to continue to retain alloying elements in solid solution, typically at temperatures less than 400° F.

As will be appreciated by those skilled in the art, the extent of the reductions in thickness effected by the hot rolling and cold rolling operations of the present invention are subject to a wide variation, depending upon the types of alloys employed, their chemistry and the manner in which they are produced. For that reason, the percentage reduction in thickness of each of the hot rolling and cold rolling operations of the invention is not critical to the practice of the invention. In general, good results are obtained when the hot rolling operation effects reduction in thickness within the range of 15 to 99% and the cold rolling effects a reduction within the range from 10 to 85%. As will be appreciated by those skilled in the art, strip casting carried out in accordance with the most preferred embodiment of the invention provides a feedstock which does not necessarily require a hot rolling step as outlined above.

As indicated, the concept of the present invention make it possible to utilize, as sheets stock for fabricating can ends and tabs, aluminum alloys containing smaller quantities of alloying elements as compared to the prior art. As a general proposition, the concepts of the present invention may be applied to aluminum alloys containing less than 2% magnesium. Representative of suitable aluminum alloys include the 3000 series of aluminum alloys such as AA3004 and AA3104. Because of the unique combination of processing steps employed in the practice of the invention, it is possible to obtain strength and formability levels with such low alloy content aluminum alloys that are equal to or better than the more expensive aluminum alloy heretofore used. In general, such alloys contain 0 to about 0.6% by weight silicon, from 0 to about 0.8% by weight iron, 0 to about 0.6% by weight copper, about 0.2 to 1.5% by weight manganese, about 0.2 to 2% by weight magnesium and about 0 to about 0.25% by weight zinc, with the balance being aluminum with its usual impurities. In the preferred embodiment, the aluminum alloy contains more than 0.6% by weight magnesium.

In general, such aluminum alloys treated in accordance with the practice of the present invention have ultimate tensile strengths and yield strengths greater than 50,000 psi.

Having described the basic concept of the present invention, reference is now made to the following examples which are provided by way of illustration and not by way of limitation to the invention.

EXAMPLE

An aluminum alloy with the following composition was strip cast to a thickness of a 0.090 inches:

| Element | Percentage By Weight |
|---|---|
| Si | 0.3 |
| Fe | 0.45 |
| Cu | 0.2 |
| Mn | 0.90 |
| Mg | 0.80 |
| Aluminum and Impurities | Balance |

The hot cast strip was then immediately rolled to a thickness of 0.045 inches and heated for five seconds at a temperature of 1000° F. and immediately thereafter quenched in water. The feedstock was then rolled to a thickness of 0.0116 inches and stabilized at 320° F. for two hours at finish gauge. It had an ultimate tensile strength of 56,000 psi, a yield strength of 50,600 psi and 7.2% elongation.

It will be understood that various changes in the details of procedure and formulation can be made without departing from the spirit of the invention, especially as defined in the following claims.

What is claimed is:

1. A method for making can end and tab stock for aluminum alloy containers comprising the steps of:

(a) strip casting an aluminum alloy by depositing molted aluminum between a pair of continuously moving metal belts to form a hot strip cast feedstock to be used to make can ends or tabs, (b) rapidly quenching the hot feedstock to prevent substantial precipitation of alloying elements as intermetallic compounds, (c) rapidly heating the feedstock to anneal the feedstock and effect recrystallization without causing substantial precipitation of alloying elements, (d) quenching the annealed feedstock to avoid substantial precipitation of alloying elements, and (e) cold rolling the quenched feedstock to reduce the thickness of the feedstock.

2. A method as defined in claim 1 wherein the aluminum alloy contains less than 2% magnesium.

3. A method as defined in claim 1 wherein the aluminum alloy contains more than 0.6% by weight magnesium.

4. A method as defined in claim 1 which includes step of hot rolling immediately after strip casting and before quenching.

5. A method as defined in claim 1 wherein each of the steps is carried out in a continuous in-line sequence.

6. A method as defined in claim 1 which includes the step of forming the finished feedstock into a can lid.

7. A method as defined in claim 1 which includes the step of forming the finished feedstock into a tab.

8. A method as defined in claim 1 wherein the strip cast feedstock has a thickness less than 1.0 inches.

9. A method as defined in claim 1 wherein the moving molten belts are cooled before contacting the molten aluminum.

10. A method as defined in claim 1 wherein the quenching cools the feedstock to a temperature below 550° F.

11. A method as defined in claim 1 which includes the steps of aging the cold rolling feedstock at a temperature ranging from 220°–400° F. for at least one hour to increase the strength of the feedstock.

12. A method as defined in claim 1 wherein the strip cast feedstock has a width less than 24 inches.

13. A method as defined in claim 1 wherein the cold rolling affects a reduction in the thickness feedstock within the range of 10–85%.

14. A method as defined in claim 1 wherein the aluminum alloy contains 0 to about 0.6% by weight silicon, from 0 to about 0.8% by weight iron, 0 to about 0.6% by weight copper, about 0.2 to 1.5% by weight manganese, about 0.2 to 2% by weight magnesium and about 0 to about 0.25% by weight zinc, with the balance being aluminum with its usual impurities.

15. A can lid or tab stock for aluminum alloy containers formed of aluminum alloy containing less than about 2% by weight magnesium and having an ultimate tensile strength of at least 50,000 psi produced by strip casting an aluminum alloy to form a hot feedstock, rapidly quenching the hot feedstock to prevent substantial precipitation of alloying elements, rapidly heating the feedstock to anneal the feedstock and effect recrystallization without causing substantial precipitation of alloying elements, quenching the annealed feedstock to avoid substantial precipitation of alloying elements and cold rolling the quenched feedstock to reduce its thickness.

16. A can lid or tab stock as defined in claim 15 wherein the aluminum alloy contains more than 0.6% by weight magnesium.

17. A can lid or tab stock as defined in claim 15 wherein the alloy has been aged after cold rolling of the feedstock at a temperature ranging from 220°–400° F. for at least one hour to increase the strength of the feedstock.

18. A can lid or tab stock as defined in claim 15 wherein the aluminum alloy contains 0 to about 0.6% by weight silicon, from 0 to about 0.8% by weight iron, 0 to about 0.6% by weight copper, about 0.2 to 1.5% by weight manganese, about 0.2 to 2% by weight magnesium and about 0 to about 0.25% by weight zinc, with the balance being aluminum with its usual impurities.

19. A can lid or tab stock for aluminum alloy containers formed of aluminum alloy containing less than about 2% by weight magnesium, produced by strip or belt casting an aluminum alloy to form a hot feedstock, rapidly quenching the hot end or tab feedstock to prevent substantial precipitation of alloying elements as intermetallic compounds, rapidly heating the end or tab feedstock to anneal the feedstock and effect recrystallization without causing substantial precipitation of alloying elements, quenching the annealed end or tab feedstock to avoid substantial precipitation of alloying elements, and cold rolling the quenched end or tab feedstock to reduce the thickness of the feedstock.

20. A can lid or tab stock as defined in claim 19 wherein the aluminum alloy contains more than 0.6% by weight magnesium.

21. A can lid or tab stock as defined in claim 19 wherein the alloy has been aged after cold rolling of the feed-stock at a temperature ranging from 220°–400° F. for at least one hour to increase the strength of the feedstock.

22. A can lid or tab stock as defined in claim 19 wherein the aluminum alloy contains 0 to about 0.6% by weight silicon, from 0 to about 0.8% by weight iron, 0 to about 0.6% by weight copper, about 0.2 to 1.5% by weight manganese, about 0.2 to 2% by weight magnesium and about 0 to about 0.25% by weight zinc, with the balance being aluminum with its usual impurities.

23. A can lid or tab for aluminum alloy containers formed of aluminum alloy containing less than about 2% by weight magnesium, produced by strip or belt casting an aluminum alloy to form a hot feedstock, rapidly quenching the hot end or tab feedstock to prevent substantial precipitation of alloying elements as intermetallic compounds, rapidly heating the end or tab feedstock to anneal the feedstock and effect recrystallization without causing substantial precipitation of alloying elements, quenching the annealed end or tab feedstock to avoid substantial precipitation of alloying elements, and cold rolling the quenched end or tab feedstock to reduce the thickness of the feedstock.

24. A can lid or tab as defined in claim 23 wherein the aluminum alloy contains more than 0.6% by weight magnesium.

25. A can lid or tab as defined in claim 23 wherein the alloy has been aged after cold rolling of the feed-stock at a temperature ranging from 220°–400° F. for at least one hour to increase the strength of the feedstock.

26. A can lid or tab as defined in claim 23 wherein the aluminum alloy contains 0 to about 0.6% by weight silicon, from 0 to about 0.8% by about 0.6% by weight copper, about 0.2 to 1.5% by weight manganese, about 0.2 to 2% by weight magnesium and about 0 to about 0.25% by weight zinc, with the balance being aluminum with its usual impurities.

27. A can lid or tab as defined in claim 23 wherein the aluminum alloy has an ultimate tensile strength of at least 50,000 psi.

* * * * *